United States Patent [19]

Thornhill

[11] 3,987,951

[45] Oct. 26, 1976

[54] UPRIGHT STAPLER

[75] Inventor: Steven E. Thornhill, Menlo Park, Calif.

[73] Assignee: Gail M. Thornhill, Riverside, Ill.

[22] Filed: Nov. 5, 1975

[21] Appl. No.: 629,203

[52] U.S. Cl. ..... 227/120; 227/156

[51] Int. Cl.[2] ..... B25C 5/02

[58] Field of Search ..... 227/110, 120, 140, 148, 227/156; D8/49, 50

[56] References Cited

UNITED STATES PATENTS

| | | | |
|---|---|---|---|
| 1,586,583 | 6/1926 | Skrebba | 227/148 |
| 2,328,983 | 9/1943 | La Place | 227/120 |
| 2,418,118 | 4/1947 | Hamilton et al. | 227/110 |
| 3,360,176 | 12/1967 | Gehl et al. | 227/148 |

*Primary Examiner*—Granville Y. Custer, Jr.
*Attorney, Agent, or Firm*—Townsend and Townsend

[57] ABSTRACT

A stapler having a pair of elongated members pivotally interconnected at first ends thereof by a hinge pin so that the opposite ends of the members can move toward and away from each other to effect a stapling operation. One of the members carries an anvil at its opposite end and the other member has means at the opposite end for dispensing staples through sheet material and against the anvil when the members are squeezed together by the hand after the sheet has been placed between the members. Such dispensing means includes a pair of relatively shiftable elements including a ram for dislodging and driving the end staple of a group of staples through an opening in one of the elements and toward the anvil. The members are provided with leg means on the lower ends thereof for positioning the stapler on a supporting surface in an upright, stabilized position so that the members can be grasped by the hand and moved together when the hand is squeezed.

6 Claims, 4 Drawing Figures

4
4

UPRIGHT STAPLER

This invention relates to improvements in staplers and, more particularly, to a stapler which is supported in an upright position on a supporting surface.

BACKGROUND OF THE INVENTION

Conventional paper staplers typically are made in various designs, sizes and shapes. For the most part, they all have two elongated, relatively shiftable members, one member having an anvil and the other member having a staple dispensing mechanism. Each such conventional stapler has its two members normally horizontally disposed when disposed on a supporting surface. Thus, it can either be used for stapling when so disposed or it can be picked up and used for stapling by pressing the two members together with one or both hands.

People who use conventional staplers find it more and more practical to pick up the stapler and orient it for stapling by positioning the anvil and stapling portion toward the base of the hand, i.e., that part of the hand near the wrist, while the pivotal end of the two members are at the upper part of the hand. Thus, when sheet material is inserted between the anvil and the stapling portion, the base of the hand is used to apply the main force which causes the two members to move together and causes a staple to be dispensed through the sheet material. This is generally because more force can be exerted on the members by the base of the hand than by the fingers thereof, thereby minimizing the effort required to drive a staple through sheet material.

Since it is practical to pick up a stapler and use it in the hand, it is oftentimes necessary to manipulate the stapler in the hand to orient it properly before the stapling can occur. This can sometimes be done by the fingers of one hand, namely, the hand used for stapling; however, if a person is not too dextrous, he may require that both hands be used to orient the stapler properly in the hand used for stapling. This is because a conventional stapler which is horizontally supported first must be picked up from a supporting surface and then manipulated so that the butt of the hand is against one member of the stapler and the fingers partially encircle the other member. This manipulation cannot be avoided because the lower of the two members is too close to the supporting surface when the stapler is resting on the surface.

In view of the above shortcomings of conventional staplers, a need has arisen for a stapler which can be readily grasped and used so as to avoid manipulation as described above.

SUMMARY OF THE INVENTION

The present invention satisfies the foregoing need by providing a stapler which has the usual two relatively shiftable stapler members, including one member having an anvil and the other member having a staple dispensing mechanism. The stapler of this invention further includes leg means on one end of the stapler so that it can be supported in a generally upright position and can immediately be picked up by one hand and used immediately with no further manipulation in the hand.

The stapler preferably has the hinge axis of its two members at the normally upper end. Thus, the anvil and stapling mechansim of the two members are at the lower ends of the members adjacent to the legs. Thus, the stapler, upon being picked up, will be in the proper orientation to allow its two members to be moved together by the base of the hand rather than the fingers to minimize the exertion required to effect a stapling operation.

Another advantage of the stapler of the present invention is that, when it is at rest and supported on a surface, it literally sticks up from the surface and is much easier to see than is the conventional stapler which extends along and generally parallel to such surface. This is especially important where the stapler is to be used on a desk or other surface having considerable clutter thereon.

It is the primary object of this invention to provide an improved stapler for paper and the like wherein the stapler is provided with means for allowing the same to be disposed in an upright position on a supporting surface to facilitate grasping the stapler and also to render it more visible than is the case with conventional staplers.

Another object of this invention is to provide a stapler of the type described wherein the two elongated members of the stapler are provided with leg means at adjacent ends thereof so that the stapler can be mounted in an upright position when the legs are supported on a surface therebelow.

Still another object of this invention is to provide a stapler of the aforesaid character wherein the anvil and stapling mechanism of the two members of the stapler are at the lower end adjacent to the leg means when the stapler is in its upright standby position so that, when the stapler is picked up with one hand, the anvil and stapling mechanism will be adjacent to the base of the hand where maximum force can be exerted on the members with minimum effort.

Other objects of this invention will become apparent as the following specification progresses, reference being had to the accompanying drawing for an illustration of the invention.

Figures 1, 2, 3, 4:
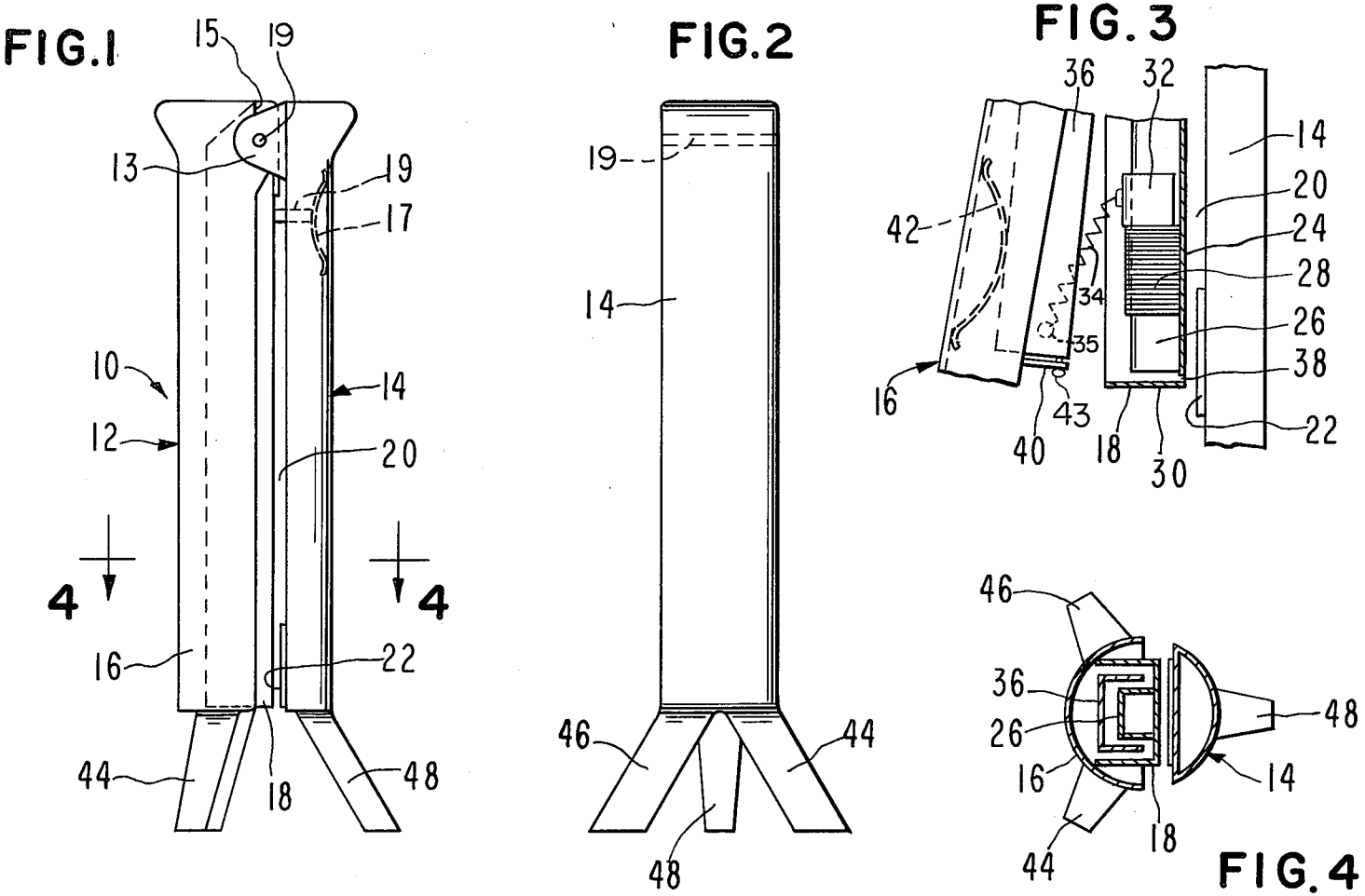
FIG. 1 is a side elevational view of the stapler of this invention, showing it in an upright position on a supporting surface.
FIG. 2 is an end elevational view of the stapler.
FIG. 3 is an enlarged, fragmentary, cross-sectional view of the stapler showing the anvil and staple dispensing mechanism thereof.
FIG. 4 is a cross-sectional view taken along line 4—4 of FIG. 1.

The stapler of this invention is broadly denoted by the numeral 10 and includes a pair of elongated members 12 and 14 which are pivotally interconnected at proximal ends thereof by a hinge pin 19. Any suitable pivot structure can be used. For instance, a pair of spaced ears 13 on member 12 can be provided to pivotally mount it on the pin and member 14 can have ear means 15 to pivotally mount it on the pin. Member 12 has a pair of relatively shiftable elements 16 and 18 and carries a number of staples as hereinafter described so that, when elements 16 and 18 are moved relative to each other, a staple is dispensed through sheet material placed in space 20 between members 12 and 14. The staple dispensed from member 12 is moved through the sheet material and against an anvil 22 carried on member 14 in alignment with the path of the staple dispensed from member 12. The anvil and staple dispensing mechanism of stapler 10 are conventional in that a staple is dispensed each time members 12 and 14 are moved together to cause a relative movement not only between these two members but also a relative movement between elements 16 and 18. Members 12 and 14 are biased away from each other in any suitable manner such as by a leaf spring 17 (FIGS. 1 and 4) carried by member 14 and engaging a rigid projection 19 carried by element 18. The outer surfaces of members 12 and 14 are curved or convex as shown in FIG. 4. This facilitates gripping the stapler in one hand.

Stapler 10 has a conventional stapling mechanism as shown in FIG. 3, wherein element 18 is provided with an outer sidewall 24 facing member 14. A fixed rail 26 is secured to the inner surface of the wall. A group of staples 28 are slidable along on the rail and are urged toward the lower end wall 30 of element 18 by a pusher 32 urged forwardly by a coil spring 34 connected at one end to the pusher and at its opposite end to a pin 35 at one end of a bar 36 on element 16. Thus, the group of staples move so that the end staple is always in alignment with an opening 38 in sidewall 24 and is off the rail; thus, a driver 40 carried by element 16 can urge the end staple through opening 38, through sheet material in space 20, and against anvil 22 when members 12 and 14 are squeezed together in the palm of the hand. Bar 36 is pivotally mounted for movement relative to elements 16 and 18 when the same are moved toward member 14. A leaf spring 42 (FIG. 3) biases bar 36 to an outer position. A stop 43 on one end of bar 36 near pin 35 extends through a slot (not shown) in driver 40 and limits the movement of bar 36 outwardly by spring 42.

Members 12 and 14 have leg means at the normally lowermost ends thereof for mounting stapler 10 in an upright position as shown in FIGS. 1 and 2. Three such legs are shown in FIGS. 1, 2 and 4. A pair of legs 44 and 46 are mounted on the lower end of element 16 and extend downwardly and outwardly therefrom. A single leg 48 is mounted on the lower end of member 14 and extends downwardly and outwardly therefrom. Legs 44 and 46 diverge from each other as shown in FIG. 4. It is possible that member 14 could have two legs and member 12 could have a single leg. Other leg configurations can be used; however, three legs are preferable for use with stapler 10 to obtain a three-point contact with the surface 50 on which the stapler is to be supported. The three-leg construction also gives sufficient stability to the stapler to prevent it from toppling. With the three legs at the lower ends of members 12 and 14, stapler 10 extends substantially perpendicualr to surface 50; however, it is possible that the members could be slightly inclined; they do not need to be perpendicular to the surface.

In use, with stapler 10 provided with a group of staples 28 in the manner shown in FIG. 3, the stapler can be picked up in one hand with the base of the hand against the outer curved surface of one of members 12 and 14 and the fingers at least partially encircling the other such member. There need be no manipulation of the stapler in the hand once it is picked up because it is immediately in the proper position to stapling when it is picked up.

Sheet material held by the other hand is then inserted in space 20 either by moving the stapler onto the sheet material, by moving the sheet material into the space, or a combination of both movements. Then by squeezing members 12 and 14 together, a staple is driven through the sheet material and against the anvil to bend the end portions of the staple in the usual manner. Release of the members allows the removal of the sheet material from the space 20. The stapler can then be returned to its upright position with the legs engaging and supported on surface 50.

The shape of the stapler and the legs thereon permits it to stand in an upright position at all times and be readily visible since it will extend lengthwise upwardly from the support surface as contrasted with conventional staplers which extend lengthwise horizontally of a support surface. The construction of the present invention simplifies the picking up of the stapler because it does not have to be oriented in the hand once it has been picked up. The position of the hand on the stapler at the time it is picked up is the same position of the hand on the stapler when the latter is used. The base of the hand against one of the members 12 and 14 assures a maximum stapling force with minimal exertion on the hand. Thus, it is advantageous that the stapling operation be performed at the end of the stapler adjacent to legs 44–48; otherwise, if the hinge pin were at the normally lowermost end of the stapler and the anvil and stapling machanism were at the normally uppermost end, more strain on the fingers would be required to move the members together for a stapling operation.

While the structure of FIG. 3 is shown to illustrate the stapling mechanism, other such mechanisms could be used to carry out the teachings of this invention.

I claim:

1. A stapler comprising: a pair of elongated members, each member having first and second ends; means pivotally mounting the first ends of the members together to permit the members to move toward and away from each other; means coupled with the members for biasing the same in a direction away from each other, one of said members having an anvil at its second end and the other member having a staple dispensing mechanism at its second end, the mechanism being aligned with the anvil and operable to dispense a staple toward and against the anvil when the members are moved toward each other, whereby sheet material placed between the members can be stapled; and leg means mounted on one of the ends of each member for supporting the members in an upright position when the leg means engages a surface therebelow.

2. A stapler as set forth in claim 1, wherein the leg means are on the second ends of the members.

3. A stapler as set forth in claim 2, wherein the leg means comprises a leg on a first of the members and two legs on the second of said members to provide a three-point contact on the surface therebelow.

4. A stapler as set forth in claim 1, wherein said leg means comprises a pair of legs on said one member and a single leg on the other member, said legs extending downwardly and outwardly from respective members, said pair of legs being divergent relative to each other.

5. A stapler as set forth in claim 1, wherein the outer surface of the stapler members is transversely convex.

6. A stapler comprising: a pair of elongated members, each member having a normally upper end and a normally lower end; means pivotally mounting the upper ends of the members together to permit the lower end to move toward and away from each other, each member having a convex outer surface, one member having an anvil adjacent to its lower end, the other member having a staple dispensing mechanism at its lower end, the mechanism being aligned with the anvil and being operable to dispense a staple toward and against the anvil when the members are pivoted toward each other; means biasing the members into relative positions permitting sheet material to be stapled to be inserted between the anvil and the mechanism; a pair of legs on a first of the members; and a single leg on the second of said members, the legs extending downwardly and outwardly from respective members, said pair of legs being divergent relative to each other.

* * * * *